US005125537A

United States Patent [19]

Slapin et al.

[11] Patent Number: 5,125,537

[45] Date of Patent: Jun. 30, 1992

[54] DISPENSING DEVICE

[76] Inventors: Jana Slapin, 319 E. 53 St. - Apt. 2B, New York, N.Y. 10036; Barbara Slapin, 207 Valley Rd., River Edge, N.J. 07661

[21] Appl. No.: 652,654

[22] Filed: Feb. 8, 1991

[51] Int. Cl.[5] ..... B65D 21/02

[52] U.S. Cl. ..... 222/143; 220/23.4; 220/23.83; 222/556

[58] Field of Search ..... 222/143, 556, 546, 498; D7/614, 615, 505, 552; D9/341, 347, 339, 349; 206/430, 431, 217; 220/23.4, 23.83, 23.86

[56] References Cited

U.S. PATENT DOCUMENTS

| | | | |
|---|---|---|---|
| D. 86,084 | 1/1932 | Green . | |
| 105,269 | 7/1870 | Spencer | D12/92 |
| D. 270,519 | 9/1983 | Post | D9/341 |
| D. 278,513 | 4/1985 | Ebeling et al | D9/339 |
| D. 279,621 | 7/1985 | Richer | D7/615 X |
| D. 281,824 | 12/1985 | Field | D28/76 |
| D. 294,222 | 2/1988 | Donohoe et al. | D9/337 |
| 1,977,092 | 10/1934 | Scurlock | D7/615 X |
| 2,030,899 | 2/1936 | Scurlock | 211/77 |
| 2,110,921 | 3/1938 | Scurlock | 220/23.4 |
| 3,187,757 | 6/1965 | Jones, Jr. et al. | 222/143 |
| 3,384,260 | 5/1968 | Buffington | 220/23.4 X |
| 3,385,465 | 5/1968 | Bliss | 220/94 A |
| 3,398,827 | 8/1968 | Laskin | 220/23.4 X |
| 3,747,754 | 7/1973 | Nix et al. | 220/23.4 X |
| 4,139,114 | 2/1979 | Long et al. | 220/23.4 |
| 4,194,619 | 3/1980 | Schley | 220/23.4 X |

*Primary Examiner*—Robert P. Olszewski
*Assistant Examiner*—James R. Bidwell
*Attorney, Agent, or Firm*—Rosenman & Colin

[57] ABSTRACT

A dispensing device is produced which is useful for dispensing a plurality of liquids which comprises a geometrically shaped base having secured thereto a geometrically shape centrally disposed member which is hollow in the center, a plurality of containers geometrically shaped to be placed on the base with one surface of each contacting the top surface of the base and another surface of each container contacting the centrally disposed member, each container having openable and closeable orifices for dispensing the liquid contained therein.

4 Claims, 3 Drawing Sheets

FIG. 1
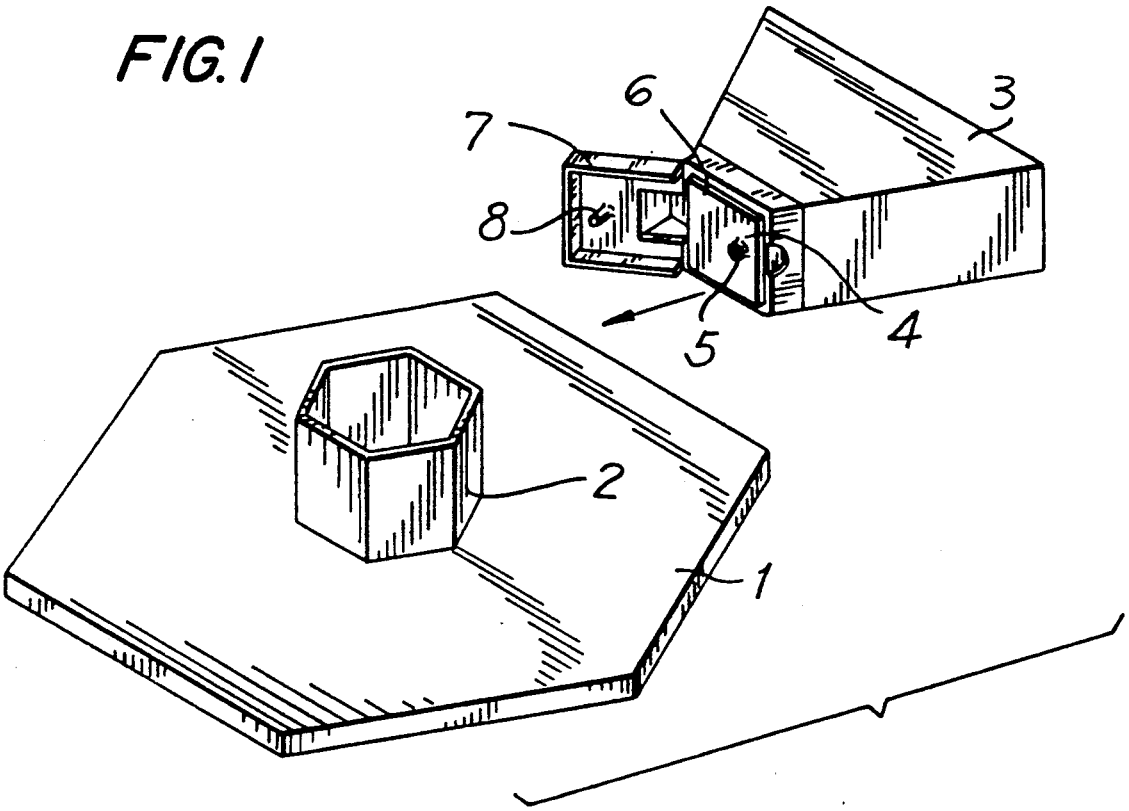
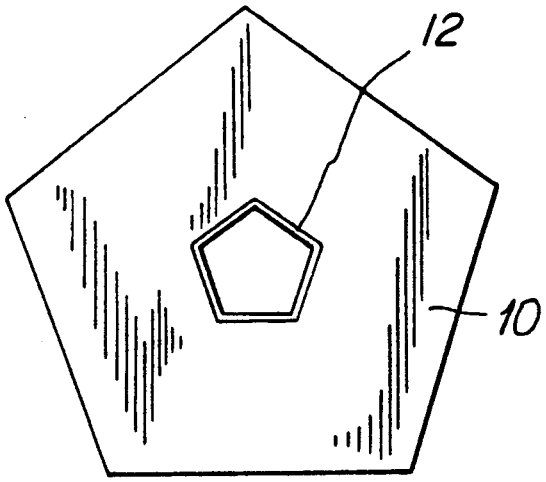
FIG. 4

FIG. 5
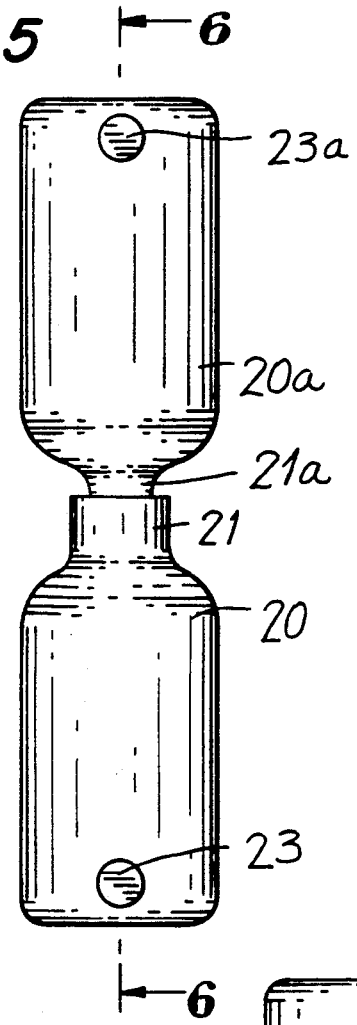
FIG. 6
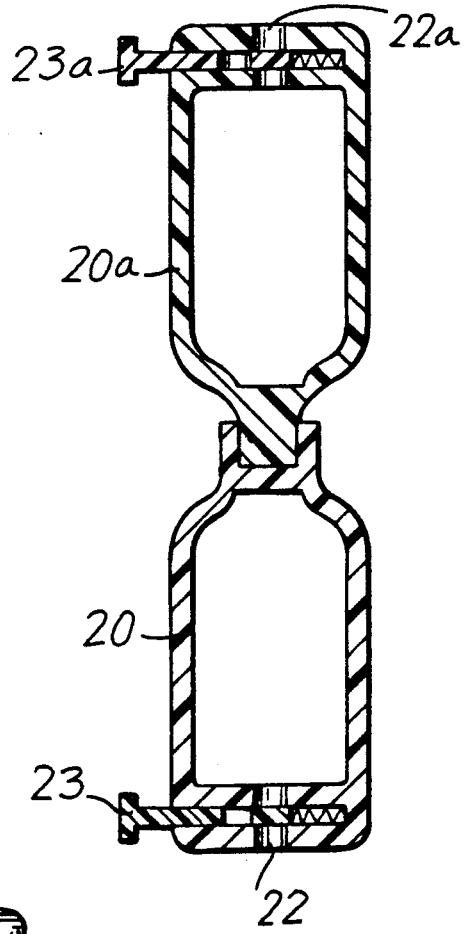
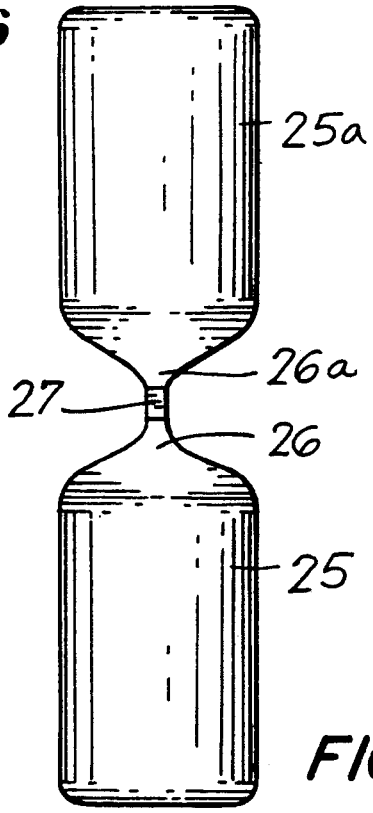
FIG. 7

DISPENSING DEVICE

The present invention is concerned with devices for dispensing two or more liquids while being in a stable shape and a pleasing configuration.

Various liquid dispensing devices are known in the art. Generally these are compartmentalized devices According to one embodiment, the present invention resides in the design of a dispensing device for dispensing a plurality of liquids which comprises a geometrically shaped base having secured thereto a geometrically shaped centrally disposed member which is hollow in the center, a plurality of containers geometrically shaped to be placed on the base with one surface of each contacting the top surface of the base and another surface of each container contacting the centrally disposed member, each container having means for dispensing the liquid contained therein.

According to a further embodiment of the present invention, each container has a top member having disposed therethrough the means for dispensing the liquid in the container and a hinged top cover which closes and opens the dispensing means.

According to a further embodiment of the present invention, the device comprises a pentagonal shaped based having secured thereto a pentagonal shaped centrally disposed member which is hollow in the center and five containers each of which has four surfaces comprising four sides, a top and a bottom and is shaped to be placed on the top surface of the base around a centrally disposed member so that the top of each container contacts one surface of the pentagonal shaped centrally disposed member, each container top having means therethrough for dispensing the liquid from the container whereby with the five containers placed around the centrally disposed member, the device is pentagonal and each of the five containers can be individually removed from the base.

According to a further embodiment of the present invention, the dispensing means comprises an orifice or a valve and each top has a cover hinged thereto which has means for closing the orifice or valve.

According to a further embodiment of the present invention, the dispensing device comprises a hexagonal shaped base having secured thereto a hexagonal shaped centrally disposed member which is hollow in the center and six containers each of which has four surfaces comprising four sides, a top and a bottom and is shaped to be placed on the top surface of the base surround a centrally disposed member so that the top of each container contacts one surface of the hexagonal shape centrally disposed member, each container top having means therethrough for dispensing the liquid from the container whereby with the six containers placed around the centrally disposed member, the device is hexagonal and each of the six containers can be individually removed from the base.

According to a further embodiment of the present invention, the dispensing means comprises an orifice or a valve and each top has a cover hinged thereto which has means for closing the orifice or valve.

According to a further embodiment of the present invention, the dispensing device may be one for dispensing two liquids from a stable aesthetically pleasing device wherein the two liquids are maintained out of contact with each other which comprises two cylindrically shaped containers, each of which has a neck and each of which has a means for dispensing the liquid contained therein, the neck of one of the containers is of smaller diameter than that of the other, the neck of smaller diameter is closed and the neck of larger diameter is closed at the base and is open to a depth sufficient to enable the smaller diameter neck to be placed therein in a secure push fit.

According to a further embodiment of the present invention, the dispensing means comprises an orifice to the bottom surface of the container with a larger diameter neck and an orifice to the surface of the container with the smaller diameter neck which is the bottom surface prior to inversion and placement of the neck within the neck of larger diameter.

According to a further embodiment of the present invention, a dispensing device for dispensing two liquids is constructed wherein the liquids are maintained out of contact with one another which comprises two cylindrical containers having necks of substantially equal diameter secured by their necks to each other, each container having means for dispensing the liquid contained in each container.

The present invention may also be appreciated by reference to FIGS. 1 through 7 wherein:

FIG. 1 shows one embodiment of the present invention showing a base member capable of holding a plurality of dispensing devices according to the present invention;

FIG. 4 is a top view of a base similar to that of FIG. 1 but pentagonal in shape;

FIG. 5 shows an alternate dispensing device according to the present invention for dispensing two liquids;

FIG. 6 is a sectional taken along lines 6—6 of FIG. 5; and

FIG. 7 shows an alternative dispensing device to that of FIGS. 5 and 6 for dispensing two liquids.

Figure 2:
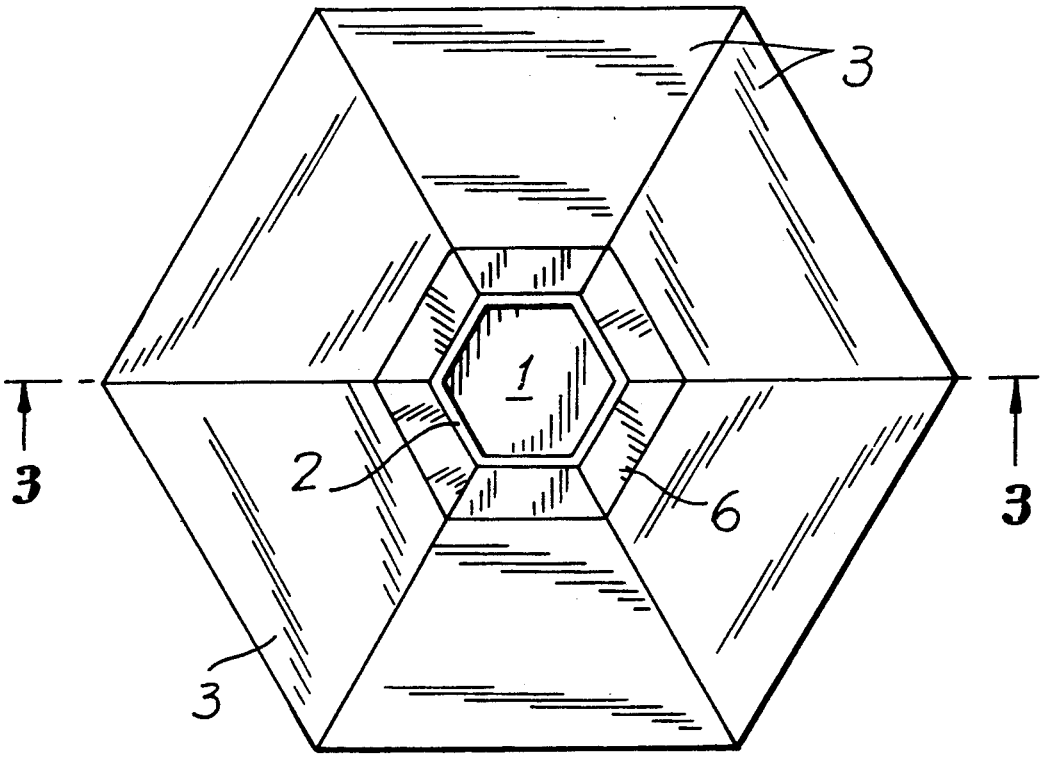
FIG. 2 is a top view of the dispensing device of FIG. 1 having six dispensing devices secured in place.
Figure 3:
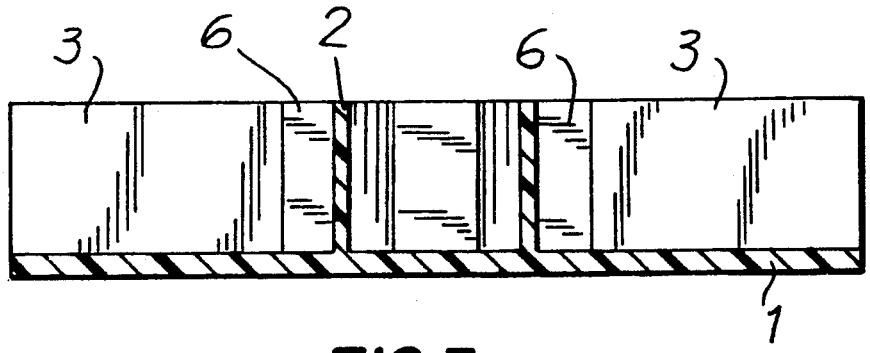
FIG. 3 is a sectional taken along lines 3—3 of FIG. 2.

More particularly, the dispensing devices of the present invention comprise according to one embodiment a base member 1 which is multi-sided, for example, hexagonal in shape as shown in FIGS. 1 and 2, which has a central member 2 having the same number of sides as base member 1 centrally disposed with respect to said base 1 and secured thereto, said central member 2 being open in the center. Individual containers 3, having dispensing means 4 in the top surface thereof such as shown in FIG. 1 where dispensing means 4 is said in the top member 6. Containers 3 may have a suitable valve such as 5 in the top member 6 which may be closed by a valve closure 8 in top cover 7. When not in use, top cover 7 is closed and the containers 3 are set around central member 2 as shown in FIG. 2. In use, each container 3 when desired is removed from central member 2 in base 1, top cover 7 is open and the liquid contained within container 3 may be dispensed by squeezing container 3 which allows the contents to be dispensed through valve 5 and dispensing means 4.

Alternatively, the multi-sided base may be pentagonal in shape, as shown in base 10 of FIG. 4, and would have central member 12 also of a pentagonal shape secured thereto and substantially centrally disposed with respect to base 10. Similar to central member 2, central member 12 is open in the center.

According to an alternate form of the present invention, a device is constructed for dispensing two liquids. Such devices are shown in FIGS. 5-7. The device of FIGS. 5 and 6 comprises a container 20 having a neck 21 and a companion container 20*a* having a neck 21*a* of smaller diameter than neck 21. Necks 21*a* and 20 are sized to provide a secure push-fit connection with sealing purposes. The liquid contained in containers 20 and 20*a* may be dispensed through dispensing orifices 22 and 22*a*, respectively, as shown in FIG. 6 through the use of means 23 and 23*a* which open and close the dispensing orifices 22 and 22*a*.

Alternatively, the device may have the form shown in FIG. 7, where container 25 and container 25*a* have necks 26 and 26*a*, respectively, of the same diameter and are joined through a connecting means 27. The device of FIG. 7 may have a similar dispensing means as shown in FIG. 6 with dispensing orifices 22 and 22*a* and means for opening and closing the orifices 23 and 23*a*.

Other and further uses will be fully appreciated by reference to the specification as a whole, the drawings and the claims of the present invention and modifications of the structure of the instant invention will also be fully appreciated by reference hereto.

What is claimed is:

1. A device for dispensing a plurality of liquids which comprises a pentagonal shaped base having secured thereto a pentagonal shaped centrally disposed member which is hollow in the center and five containers each of which has four surfaces comprising four sides, a top and a bottom and is shaped to be placed on the top surface of the base surrounding a centrally disposed member so that the top of each container contacts one surface of the pentagonal shaped centrally disposed member, each container top having means therethrough for dispensing the liquid from the container whereby with the five containers placed around the centrally disposed member, the device is pentagonal and each of the five containers can be individually removed from the base.

2. A device according to claim 1 wherein the dispensing means comprises an orifice or a valve and each top has a cover hinged thereto which has means for closing the orifice or valve.

3. A device for dispensing a plurality of liquids which comprises a hexagonal shaped base having secured thereto a hexagonal shaped centrally disposed member which is hollow in the center and six containers each of which has four surfaces comprising four sides, a top and a bottom and is shaped to be placed on the top surface of the base surrounding a centrally disposed member so that the top of each container contacts one surface of the hexagonal shaped centrally disposed member, each container top having means therethrough for dispensing the liquid from the container whereby with the six containers placed around the centrally disposed member, the device is hexagonal and each of the six containers can be individually removed from the base.

4. A device according to claim 3 wherein the dispensing means comprises an orifice or a valve and each top has a cover hinged thereto which has means for closing the orifice or valve.

* * * * *